US006362716B1

(12) United States Patent
Anbo et al.

(10) Patent No.: US 6,362,716 B1
(45) Date of Patent: Mar. 26, 2002

(54) INDUCTOR DEVICE AND PROCESS OF PRODUCTION THEREOF

(75) Inventors: Toshiyuki Anbo; Fumio Uchikoba, both of Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/347,195

(22) Filed: Jul. 2, 1999

(30) Foreign Application Priority Data

Jul. 6, 1998 (JP) ..... 10-189555

(51) Int. Cl.[7] ..... H01F 5/00
(52) U.S. Cl. ..... 336/200; 336/83
(58) Field of Search ..... 336/65, 83, 200, 336/223, 232, 205–208

(56) References Cited

U.S. PATENT DOCUMENTS 4,689,594 A * 8/1987 Kawabata et al. ..... 336/200
5,032,815 A * 7/1991 Kobayashi et al. ..... 336/83
5,291,173 A * 3/1994 Yerman et al. ..... 336/200

FOREIGN PATENT DOCUMENTS

JP 6-20843 1/1994
JP 6-77074 3/1994
JP 7-192954 7/1995
JP 7-192955 7/1995

* cited by examiner

*Primary Examiner*—Lincoln Donovan
*Assistant Examiner*—Tuyen T. Nguyen
(74) *Attorney, Agent, or Firm*—Oliff & Berridge, PLC

(57) ABSTRACT

An inductor device provided with a plurality of insulating layers; coil pattern units each formed between insulating layers; and connection portions for connecting upper and lower coil pattern units separated by the insulating layers to form a coil shape. The coil pattern units each have two substantially parallel linear patterns and a curved pattern connecting first ends of the linear patterns. The ratio A1/A2, where the total of the areas of the two linear patterns seen from the plane view is A1 and the area of the curved pattern seen from the plane view is A2, of 1.45 to 1.85, preferably 1.55 to 1.75. When the total area of a unit section of the insulating layer in which one coil pattern unit is contained is A0, the ratio (A1+A2)/A0 is in a range of 0.10 to 0.30, preferably 0.13 to 0.20.

6 Claims, 6 Drawing Sheets

INDUCTOR DEVICE AND PROCESS OF PRODUCTION THEREOF

BACKGROUND OF THE INVENTION

1. Field of the Invention

The present invention relates to an inductor device and a process of production of the same.

2. Description of the Related Art

The market is constantly demanding that electronic equipment be made smaller in size. Greater compactness is therefore required in the devices used in electronic equipment as well. Electronic devices originally having lead wires have evolved into so-called "chip devices" without lead wires along with the advances made in surface mounting technology. Capacitors, inductors, and other devices comprised mainly of ceramics are produced using the sheet process based on thick film forming techniques or using screen printing techniques etc. and using cofiring process of the ceramics and metal. This enables realization of a monolithic structure provided with internal conductors and a further reduction of size.

The following process of production has been adopted to produce such a chip-shaped inductor device.

First, a ceramic powder is mixed with a solution containing a binder or organic solvent etc. This mixture is cast on a polyethylene terephthalate (PET) film using a doctor blade method etc. to obtain a green sheet of several tens of microns or several hundreds of microns in thickness. Next, this green sheet is machined or processed by laser etc. to form through holes for connecting coil pattern units of different layers. The thus obtained green sheet is coated with a silver or a silver-palladium conductor paste by screen printing to form conductive coil pattern units corresponding to the internal conductors. At this stage, the through holes are also filled with the paste for the electrical connection between layers.

A predetermined number of these green sheets are then stacked and press-bonded at a suitable temperature and pressure, then cut into portions corresponding to individual chips which are then processed to remove the binder and sintered. The sintered chips are barrel polished, then coated with silver paste for forming the terminations and then again heat treated. These are then electrolytically plated to form a tin or other coating. As a result of the above steps, a coil structure is realized inside of the insulator comprised of the ceramic and thereby an inductor device is fabricated.

There have been even further demands for miniaturization of such inductor devices. The main chip sizes have shifted from the 3216 (3.2×1.6×0.9 mm) shape to 2012 (2.0×1.2×0.9 mm), 1608 (1.6×0.8×0.8 mm), and even further smaller shapes. Recently, chip sizes of 1005 (1×0.5×0.5 mm) have been realized. This trend toward miniaturization has gradually made the requirements for dimensional accuracy (clearance) on the steps severer in order to obtain stable and high quality.

For example, in an inductor device of a chip size of 1005, the stack deviation of the internal conductor layers is not allowed to exceed more than 30 $\mu$m. If this is exceeded, remarkable variations occur in the inductance or impedance. In extreme cases, the internal conductors are even exposed.

In the case of an inductor device of a relatively large chip size of the related art, this stack deviation was not serious enough to have a notable effect on the properties of the device, but with a chip size of about 1005, stack deviations have a tremendous effect on the device properties.

In the inductor devices of a relatively large size of the related art, the coil pattern units of the internal conductors in the different layers were L-shaped or reverse L-shaped. The L-shaped pattern units and reverse L-shaped pattern units were alternately stacked and through holes were provided at the ends of these patterns to connect the patterns of the different layers. The starting ends and finishing ends of the coil formed in this way were connected to leadout patterns.

Experiments by the present inventors etc. have shown, however, that when making the coil pattern units of the internal conductors at different layers L-shaped and reverse L-shaped and simply making the coil pattern units smaller in order to obtain a 1005 or other small-sized inductor device, the stack deviation of the internal conductors remarkably progresses.

The reason why the stack deviation progresses in a small-sized inductor device is believed to be as follows: That is, to obtain a predetermined inductance or impedance despite reduction of the chip size, it is necessary to increase the number of turns of the coil. Therefore, it is necessary to make each of the ceramic layers thinner. Further, a low resistance is required in the internal conductors, so it is not allowed to make the conductors thinner by the same rate as the ceramic sheet. Therefore, a smaller chip size results in a remarkable non-flatness of a green sheet after printing.

As a result, when applying pressure to superposed green sheets to form them into a stack, the conductor portions, which are relatively hard compared with the green sheets themselves, interfere with each other and therefore cause remarkable stack deviation. In particular, in a printing pattern based on the L-shapes of the related art, the stacked green sheets were pushed at a slant 3-dimensionally through the internal conductors—which only aggravated the stack deviation. This phenomenon became a major hurdle to be overcome for stabilization of the quality of the device along with the increased reduction of the chip size of the devices.

Various proposals have been made to solve this problem. For example, Japanese Unexamined Patent Publication (Kokai) No. 6-77074 discloses to press printed green sheets in advance in order to flatten them. Further, Japanese Unexamined Patent Publication (Kokai) No. 7-192945 discloses to give the ceramic sheets grooves identical with the conductor patterns in advance, print the conductor paste in the grooves, and thereby obtain a flat ceramic sheet containing conductors. Further, Japanese Unexamined Patent Publication (Kokai) No. 7-192955 discloses not to peel off the PET film from the ceramic sheet, but to repeatedly stack another ceramic sheet, press it, then peel off the film. This method uses the fact that PET film undergoes little deformation and as a result could be considered a means for preventing stack deviation. Further, Japanese Unexamined Patent Publication (Kokai) No. 6-20843 discloses to provide a plurality of through holes along the circumference of the printed conductors so as to disperse the pressure at the time of press-bonding.

Each of the methods disclosed in the above publications added further steps to the method of stacking the ceramic sheets of the related art or made major changes in it. Further, they were more complicated than the method of the related art and therefore disadvantageous from the viewpoint of productivity.

SUMMARY OF THE INVENTION

An object of the present invention is to provide an inductor device able to suppress stack deviation without complicating the production process—even if the device is made smaller—and a process for the production of the same.

The present inventors engaged in intensive studies of a small-sized inductor device able to suppress stack deviation without complicating the production process and a process for production of the same and as a result discovered that it is possible to suppress the stack deviation by suitably determining the pattern shape of coil pattern units formed between insulator layers of the device and thereby completed the present invention.

According to the present invention, there is provided an inductor device formed comprising a plurality of insulating layers; conductive coil pattern units each formed between insulating layers, having two substantially parallel linear patterns and a curved pattern connecting first ends of the linear patterns, and having a ratio A1/A2, where the total of the areas of the two linear patterns seen from the plane view is A1 and the area of the curved pattern seen from the plane view is A2, of 1.45 to 1.85, preferably 1.55 to 1.75, more preferably 1.62 to 1.68; and connection portions formed at second ends of the linear pattern and connecting upper and lower coil pattern units separated by the insulating layers in a coil-shape.

When A1/A2 is smaller than 1.45, the areas of the linear patterns are too small compared with the area of the curved pattern and as a result the sectional area of the coil becomes smaller and there is a tendency for a sufficient inductance not being able to be secured. When A1/A2 is larger than 1.85, the areas of the linear patterns are too large compared with the area of the curved pattern and stack deviation tends to easily occur in the direction substantially perpendicular to the longitudinal direction of the linear patterns.

In the present invention, preferably, when the total area of a unit section of the insulating layer in which one coil pattern unit is contained is A0, the ratio (A1+A2)/A0 is in a range of 0.10 to 0.30, preferably 0.13 to 0.20, more preferably 0.15 to 0.17.

When the ratio (A1+A2)/A0 is smaller than 0.10, the areas of the coil unit patterns for constituting the coil are too small compared with the area of the insulating layer and the DC resistance becomes too large, so this is not preferred. When the ratio (A1+A2)/A0 is larger than 0.30, the sectional area of the coil becomes smaller and there is a tendency for the required inductance not to be able to be secured.

In the present invention, when the line width of the linear patterns is W1 and the radius of curvature of the outer circumference of the curved pattern is R, preferably the ratio W1/R is in a range from 1/2 to 4/5 , more preferably 3/5 to 2/3.

When the ratio W1/R is smaller than 1/4 , the line width of the linear patterns is too narrow and stack deviation tends to easily progress. This is believed to be due to the fact that if the line width of the linear patterns is narrow, when a linear pattern positioned at an upper layer and a linear pattern positioned at a lower layer are superposed, stack deviation easily occurs in the direction substantially perpendicular to the longitudinal direction of the linear patterns. Further, when the ratio W1/R is larger than 4/5 , the diameter of the curved pattern becomes smaller and the line width of the patterns becomes thicker, so the diameter of the coil obtained inside the device becomes smaller and there is a tendency for the desired inductance property not to be able to be secured.

In the present invention, two coil pattern units positioned above and below an insulating layer are preferably arranged at line symmetric positions with respect to a center line dividing the insulating layer across the longitudinal direction as seen from the plane view. By arranging them in this way, it is possible to obtain an inductor device with little stack deviation while obtaining the desired inductance characteristic.

Alternatively, the coil pattern units are preferably line symmetric patterns about a center line dividing the insulating layer across the width direction seen from a plane view. By using such patterns, it is possible to obtain an inductor device with little stack deviation.

In the present invention, two or more coil pattern units may be arranged between insulating layers. By arranging a plurality of coil pattern units in this way, it is possible to obtain an inductor array device having a plurality of coils inside a single device.

According to the present invention, there is provided a process for the production of an inductor device comprising the steps of forming a green sheet to form an insulating layer; forming on the surface of the green sheet a conductive coil pattern unit having two substantially parallel linear patterns and a curved pattern connecting first ends of the linear patterns and having a ratio A1/A2, where the total of the areas of the two linear patterns seen from the plane view is A1 and the area of the curved pattern seen from the plane view is A2, of 1.45 to 1.85; stacking a plurality of green sheets formed with the coil pattern units and connecting the upper and lower coil pattern units separated by the green sheets through through holes to form a coil shape; and sintering the stacked green sheets.

The process of production according to the present invention may include, before the sintering step, a step of cutting the stacked green sheets into pieces each containing one coil pattern unit.

Alternatively, the process of production according to the present invention may include, before the sintering step, a step of cutting the stacked green sheets into pieces each containing a plurality of coil pattern units.

According to the process of production according to the present invention, it is possible to obtain an inductor device able to suppress stack deviation without complicating the production process even if the device is made small in size.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

First Embodiment

Figure 1:
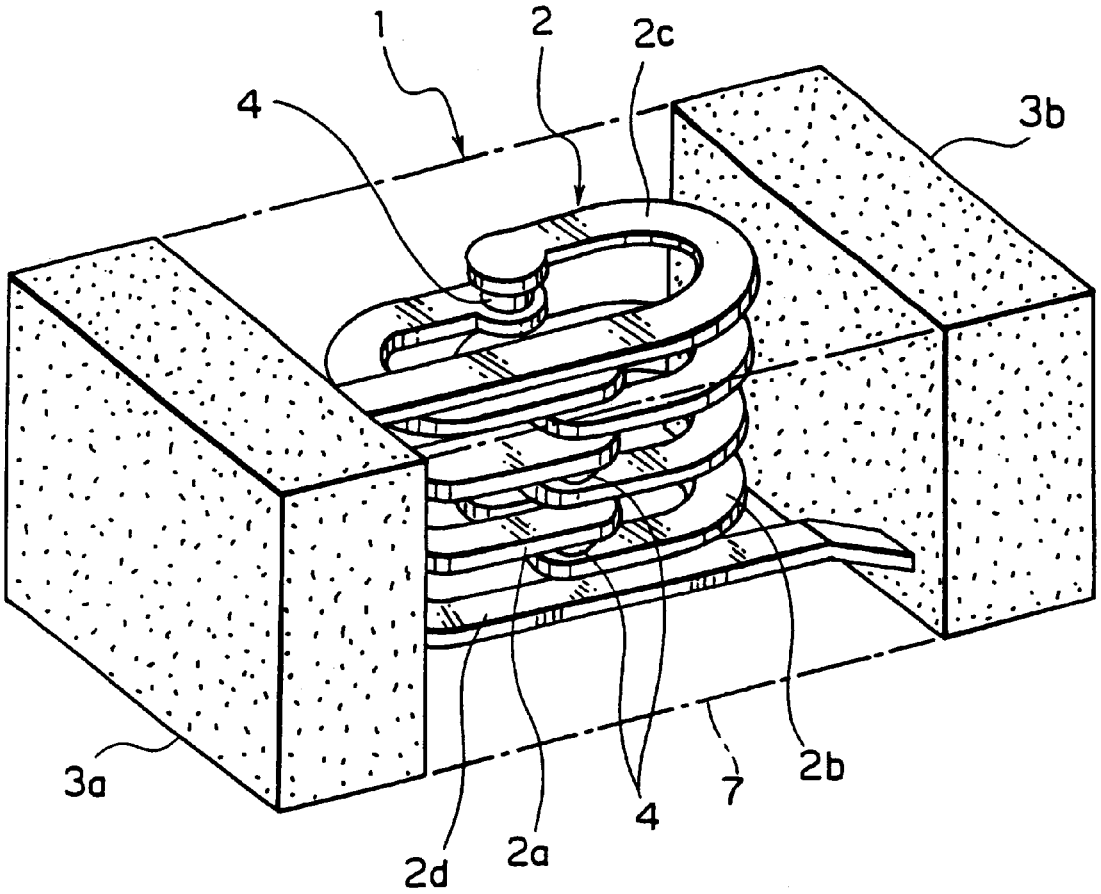
FIG. 1 is a partial transparent perspective view of an inductor device according to an embodiment of the present invention.

As shown in FIG. 1, the inductor device according to the first embodiment has a device body 1. The device body 1 has terminations 3*a* and 3*b* formed integrally at its two ends. The device body 1 further has alternately stacked inside it coil patterns 2*a* and 2*b* which lie between insulating layers 7. In the present embodiment, the end of the coil pattern unit 2*c* stacked at the top is connected to one termination 3*a*, while the end of the coil pattern unit 2*d* stacked at the bottom is connected to the other termination 3*b*. These coil pattern units 2*a*, 2*b*, 2*c*, and 2*d* are connected through through holes 4 formed in the insulating layers 7 and together constitute a coil 2.

The insulating layers 7 constituting the device body 1 are for example comprised of ferrite, a ferrite-glass composite, or other magnetic material or an alumina-glass composite, crystallized glass, or other dielectric material etc. The coil pattern units 2*a*, 2*b*, 2*c*, and 2*d* are for example comprised of silver, palladium, alloys of the same, or other metals. The terminations 3*a* and 3*b* are sintered members comprised mainly of silver and are plated on their surfaces with copper, nickel, tin, tin-lead alloys, or other metals. The terminations 3*a* and 3*b* may be comprised of single layers or multiple layers of these metals.

Figure 2A:
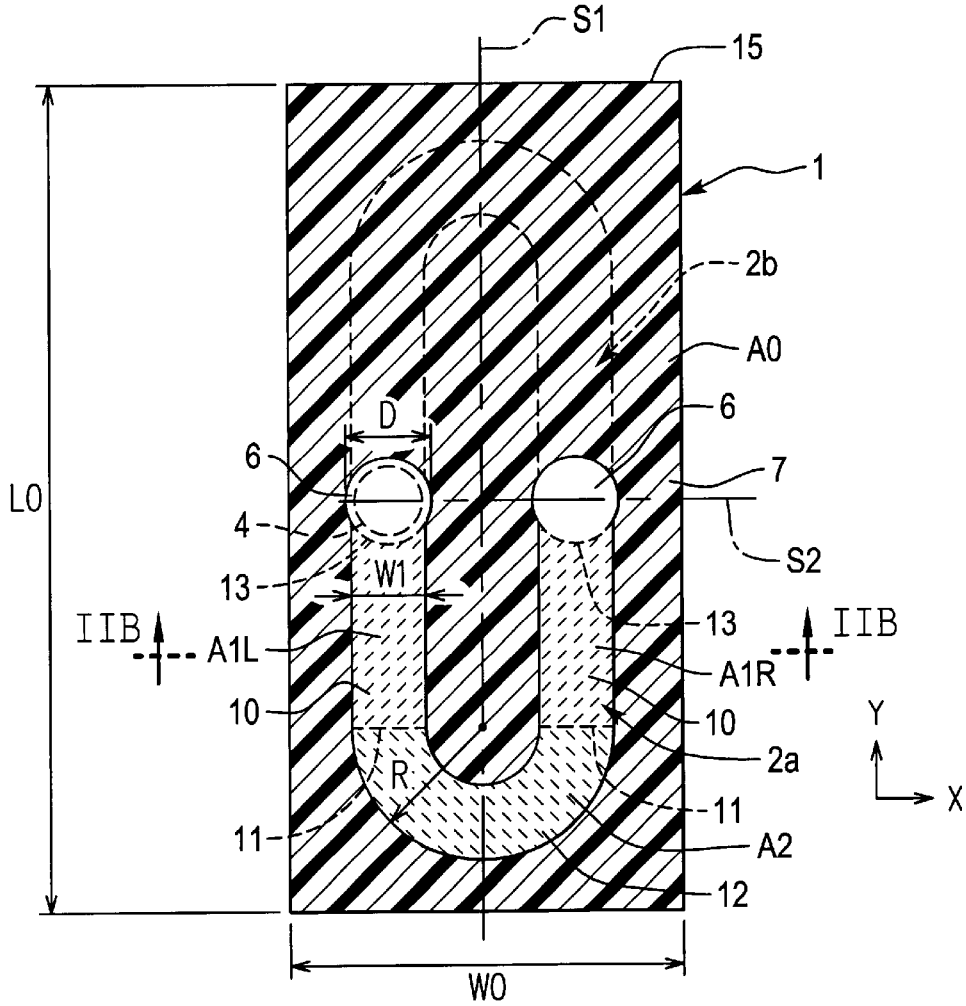
FIG. 2A is a plane view of a coil pattern unit to be stacked inside the inductor device shown in FIG. 1.

As shown in FIG. 2A, each of the coil pattern units 2*a* and 2*b* arranged in the middle of the device body 1 has a substantially U-shape as a whole seen from the plane view and is provided with two substantially parallel linear patterns 10, a curved pattern 12 connecting first ends 11 of these linear patterns 10, and connection portions 6 formed at second ends 13 of the linear patterns 10.

In this embodiment, as shown in FIG. 2A, the insulating layer 7 has an elongated unit section 15 in the longitudinal direction. The width W0 is not particularly limited, but may be from 1.6 to 0.3 mm. The longitudinal length L0 is a length of about 3.2 to 0.6 times W0.

The coil pattern units 2*a* and 2*b* are line-symmetric patterns with respect to a center line S1 dividing the unit section 15 across the width direction in the lateral sectional view of the insulating layer 7 along the horizontal direction. Further, any one coil pattern unit 2*a* and the coil pattern unit 2*b* positioned below or above the coil pattern unit 2*a* across an insulating layer 7 are arranged at line-symmetric positions with respect to a center line S2 dividing the unit section 15 across the longitudinal direction.

The connection portions 6 of the coil pattern units 2*a* and 2*b* are circular as seen from the plane view and have an outside diameter D slightly larger than the width W1 of the linear patterns 10. The ratio D/W1 is not particularly limited, but preferably is from 1.1 to 1.5, more preferably 1.2 to 1.3.

When taking note of the coil pattern unit 2*a*, one connection portion 6 is connected through a through hole 5 to one connection portion of the coil pattern unit 2*b* positioned directly underneath it, while the other connection portion 6 of the coil pattern unit 2*a* is connected through a not shown through hole to one connection portion of the coil pattern unit 2*b* positioned directly above it. By connecting the coil pattern units 2*a* and 2*b* through the connection portions 6 and through holes 4 in a spiral fashion in this way, a small sized coil 2 is formed inside the device body 1 as shown in FIG. 1.

In this embodiment, in each of the coil patterns 2*a* and 2*b*, the ratio A1/A2, where the total of the areas A1R and A1L of the two linear patterns 10 as seen from a plane view, not including the area of the connection portion 6, is A1 and the area of the curved pattern 12 seen from the plane view is A2, is in the range of 1.45 to 1.85. By adopting this range, in the present embodiment, the curved pattern 12 has a 1/n arc shape, where n is in the range of 2 to 4. Note that a "1/n arc" means an arc with an arc length of 1/n of the circumference of a circle.

Further, in the present embodiment, the ratio (A1+A2)/A0, where the total area of one unit section of the insulating layer containing one coil pattern unit 2*a* or 2*b* seen from the plane view is A0 (=L0×W0), is in a range of 0.13 to 0.20.

Further, in the present embodiment, in the coil pattern units 2*a* and 2*b*, the ratio W1/R, where the line width of the linear patterns 10 is W1 and the radius of curvature of the outer circumference of the curved pattern 12 is R, is in a range of 1/4 to 4/5. Note that the line width W1 of the linear patterns 10 is not particularly limited, but preferably is one with respect to the lateral width W0 of one unit section 15 of the insulating layer 7 satisfying W1/W0=1/4 to 1/8 or so.

Figure 2B:
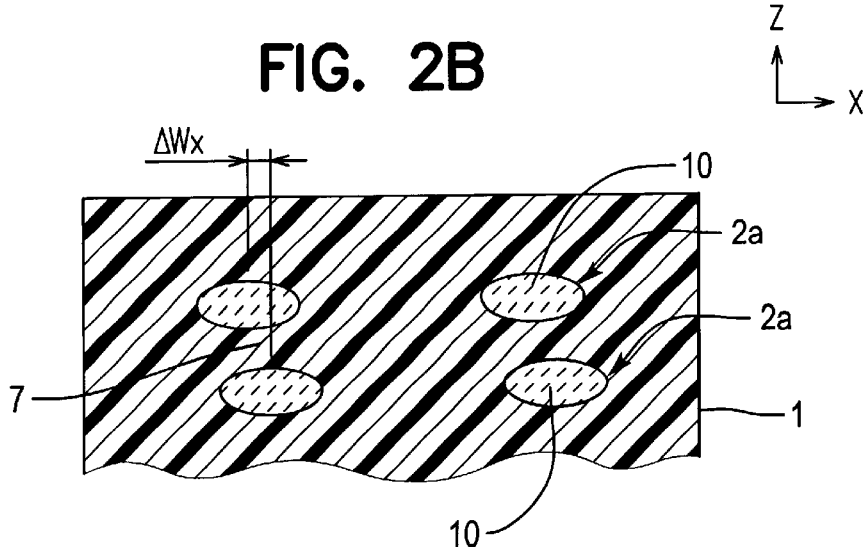
FIG. 2B is a sectional view of key parts along the line IIB—IIB of FIG. 2A.

In the present embodiment, the shapes and arrangements of the coil pattern units 2*a* and 2*b* are set to become ranges satisfying the above numerical relationships whereby, as shown in FIG. 2B, it is possible in particular to make the stack deviation ΔWx of the linear patterns 10 with respect to the direction X perpendicular to the longitudinal direction Y smaller than in the past. Further, in this embodiment, the stack deviation ΔWy of the linear patterns 10 along the longitudinal direction Y is inherently smaller than ΔWx.

Note that in the present invention, the stack deviation ΔWx in the X-direction, as shown in FIG. 2B, means the X-direction deviation of the center position between linear patterns 10 in a coil pattern 2*a* (or 2*b*) stacked in the stacking direction (vertical direction) Z sandwiching insulating layers 7. Further, the stack deviation ΔWy in the Y-direction, while not shown, means the Y-direction deviation of the center position between connection portions 6 in a coil pattern 2*a* (or 2*b*) stacked in the stacking direction (vertical direction) Z sandwiching insulating layers.

Next, an explanation will be given of a process for production of the inductor device shown in FIG. 1.

Figure 3A:
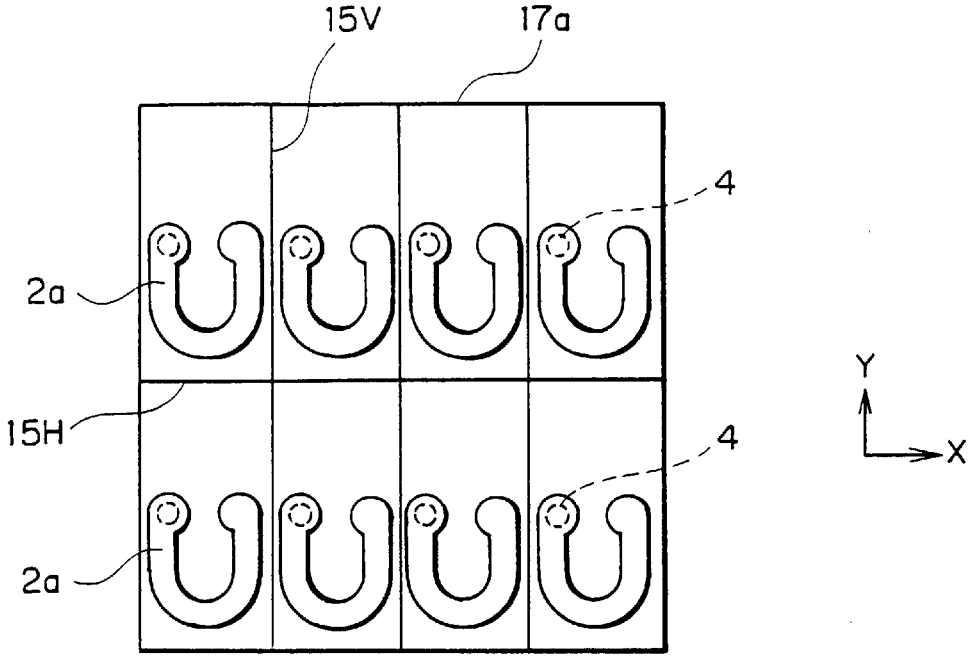
FIG. 3A and FIG. 3B are perspective views of green sheets used for the process of production of an inductor device according to an embodiment of the present invention.
Figure 3B:
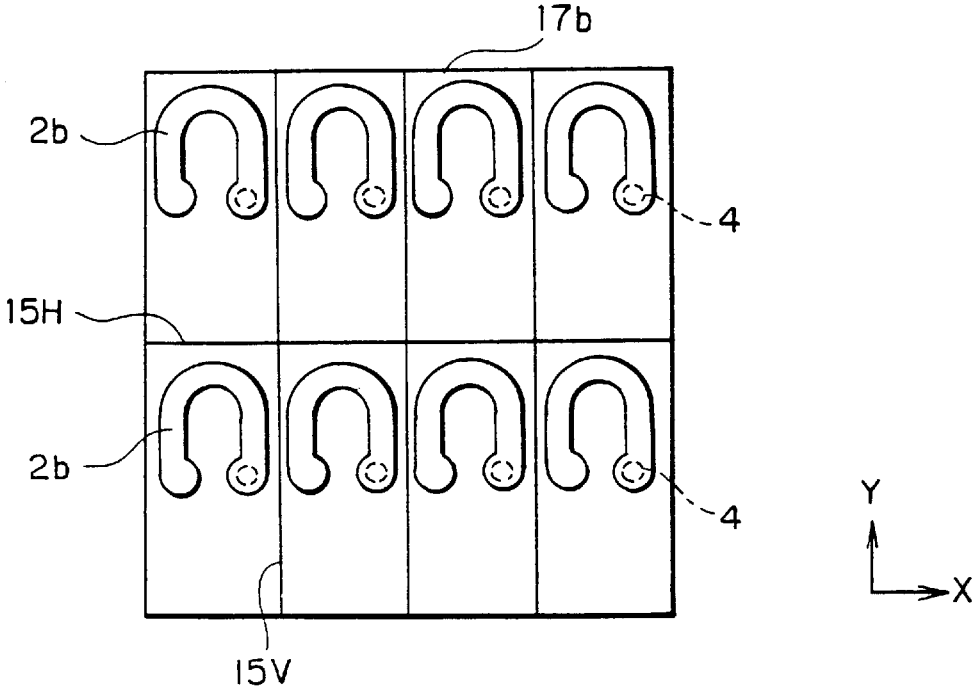

As shown in FIG. 3A and FIG. 3B, first, green sheets 17*a* and 17*b* are prepared for forming the insulating layers 7. The green sheets 17*a* and 17*b* are obtained by mixing a ceramic powder with a solution containing a binder or organic solvent etc. to form a slurry, coating the slurry on a PET film or other base film by the doctor blade method etc., drying it, then peeling off the base film. The thickness of the green sheets is not particularly limited, but is several tens of microns to several hundreds of microns.

The ceramic powder is not particularly limited, but for example is a ferrite powder, ferrite-glass composite, glass-alumina composite, crystallized glass, etc. The binder is not particularly limited, but may be a butyral resin, acrylic resin, etc. As the organic solvent, toluene, xylene, isobutyl alcohol, ethanol, etc. may be used.

Next, these green sheets 17*a* and 17*b* are machined or processed by laser etc. to form a predetermined pattern of through holes 4 for connecting coil pattern units 2*a* and 2*b* of different layers. The thus obtained green sheets 17*a* and 17*b* are coated with a silver or silver-palladium conductor paste by screen printing to form a plurality of conductive coil pattern units 2*a* and 2*b* in a matrix array. At this time, the through holes 4 are also filled with paste. The coil pattern units 2*a* and 2*b* are shaped the same as the shapes of the patterns 2*a* and 2*b* shown in FIG. 2A. The coating thickness of the coil pattern units 2*a* and 2*b* is not particularly limited, but normally is about 5 to 40 μm.

A predetermined number of these green sheets 17*a* and 17*b* are alternately superposed, then are press-bonded at a suitable temperature and pressure, then are cut into portions corresponding to individual device bodies 1 along the cut-away lines 15H and 15V. In this embodiment, the stacked green sheets are cut so that one pattern unit 2*a* or 2*b* is contained in one unit section 15 of the green sheet 17*a* or 17*b* and thereby to obtain a green chip corresponding to the device body 1. Note that in actuality, in addition to the green sheets 17*a* and 17*b*, green sheets formed with the coil pattern units 2*c* or 2*d* shown in FIG. 1 are also stacked together with the green sheets 17*a* and 17*b*. Further, green sheets not formed with any coil pattern units may also be additionally stacked and press-bonded in accordance with need.

In this embodiment, since the shapes and arrangements of the coil pattern units 2*a* and 2*b* formed at the surfaces of the green sheets 17*a* and 17*b* are set so that the above-mentioned numerical relationships are satisfied, the X-direction stack deviation ΔWx when press-bonding the green sheets 17*a* and 17*b* becomes smaller than the related art. Of course, the Y-direction stack deviation Δwy also is small.

Next, the green chip is treated to remove the binder and sintered or otherwise heat treated. The ambient temperature at the time of treatment to remove the binder is not particularly limited, but may be from 150° C. to 250° C. Further, the sintering temperature is not particularly limited, but may be from 850° C. to 960° C. or so.

Next, the two ends of the obtained sintered body are barrel polished, then coated with silver paste for forming the terminations 3*a* and 3*b* shown in FIG. 1. The chip is then again heat treated, then is electrolytically plated with tin or a tin-lead alloy or the like to obtain the terminations 3*a* and 3*b*. As a result of the above steps, a coil structure is realized inside of the insulator comprised of the ceramic and thereby an inductor device is fabricated.

Second Embodiment

Figure 6:
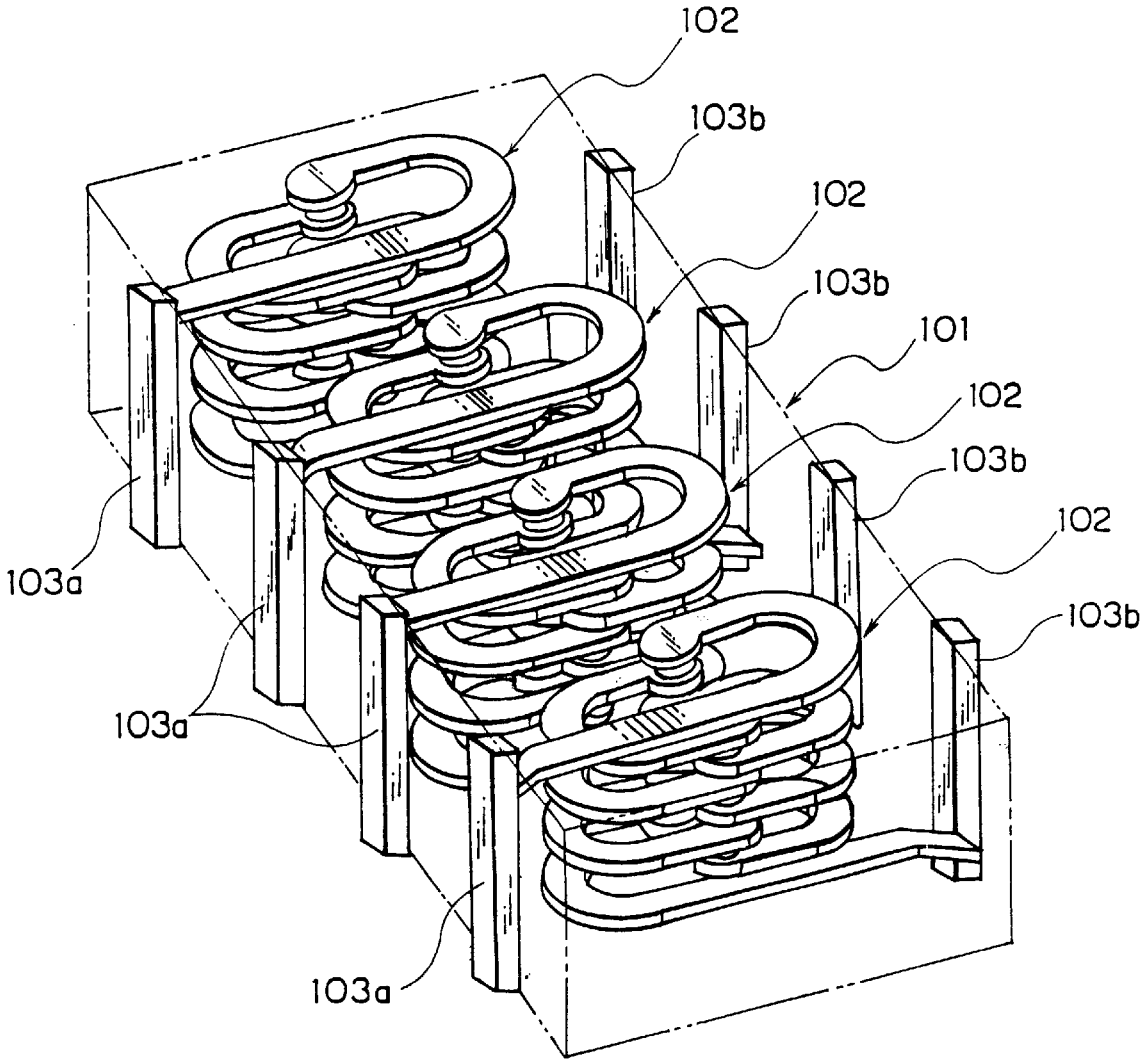
FIG. 6 is a partial transparent perspective view of an inductor device according to another embodiment of the present invention.

In the inductor array device (type of inductor device) according to the second embodiment, as shown in FIG. 6, a plurality of coils 102 are arranged inside a single device body 101 along the longitudinal direction of the device body 101. A plurality of terminations 103*a* and 103*b* are formed at the side ends of the device body 101 corresponding to the coils 102.

The inductor array device of the embodiment shown in FIG. 6 differs from the inductor device shown in FIG. 1 in the point of the formation of a plurality of coils 102 inside the device body 101, but the coils 102 are configured the same as the coil shown in FIG. 1 and exhibit similar operations and advantageous effects.

The process of production of the inductor array device shown in FIG. 6 is almost exactly the same as the process of production of the inductor device shown in FIG. 1 and differs only in the point that when cutting the green sheets 17*a* and 17*b* shown in FIG. 3A and FIG. 3B after stacking, they are cut so that a plurality of pattern units 2*a* and 2*b* remain in the green chips after cutting.

Note that the present invention is not limited to the above embodiments and may be modified in various ways without departing from the scope of the present invention.

For example, the curved pattern connecting the linear patterns of a coil pattern unit does not necessarily have to be a completely arc shape and may also be part of an ellipse or other curved shape.

Next, the present invention will be explained with reference to examples and comparative examples, but the present invention is not limited to these in any way.

EXAMPLE 1

First, the green sheets for forming the insulating layers 7 of the device body 1 shown in FIG. 1 were prepared. The green sheets were fabricated as follows: A ferrite powder comprised of $(NiCuZn)Fe_2O_4$, an organic solvent comprised of toluene, and a binder comprised of polyvinyl butyral were mixed at a predetermined ratio to obtain a slurry. The slurry was coated on a PET film using the doctor blade method and dried to obtain a plurality of green sheets of a thickness of 30 μm.

Next, the green sheets were laser processed to form a predetermined pattern of through holes of diameters of 80 μm. Next, the green sheets were coated with silver paste by screen printing and dried to form coil pattern units 2*a* and 2*b* in predetermined repeating patterns as shown in FIG. 3A and FIG. 3B.

The coil pattern units 2*a* and 2*b* had thicknesses after drying of 10 μm. As shown in FIG. 2A, each consisted of two substantially parallel linear patterns 10, a curved pattern 12, and connection portions 6. The outer diameter D of the connection portions 6 was 120 μm, while the radius r of the outer circumference of the curved pattern 12 was 150 μm. The curved pattern 12 was shaped as a complete 1/2 arc. Further, the width W1 of the linear patterns 10 was 90 μm. The width of the curved pattern 12 was substantially the same as the width W1 of the linear patterns 10. The lateral width W0 of the unit sections 15, that is, the range in which a single coil pattern unit 2*a* or 2*b* was printed, was 0.52 mm and the longitudinal length L0 was 1.1 mm.

The ratio A1/A2 when the total of the areas A1R and A1L of the linear patterns 10 seen from the plane view was A1 and the area of the curved pattern 12 seen from the plane view was A2, was 1.65. Further, the ratio (A1+A2)/A0 when the total area of the unit section 15 seen from the plane view was A0 was 0.16. Further, the ratio W1/R was 3/5.

Ten of the green sheets printed with the coil pattern units 2*a* and 2*b* in this way were alternately stacked and press-bonded at 50° C. and a pressure of 800 kg/cm$^2$, then the stack was cut using a knife and the section was observed to evaluate the maximum value of the X-direction stack deviation ΔWx.

Table 1 shows the results. The maximum value of the stack deviation ΔWx was 10 μm.

TABLE 1

| | Ex. 1 | Ex. 2 | Comp. Ex. 1 | Comp. Ex. 2 | Comp. Ex. 3 |
|---|---|---|---|---|---|
| Drawing | FIG. 2A | FIG. 4A | FIG. 4B | FIG. 5A | FIG. 5B |
| Line width W1 (μm) | 90 | 90 | 90 | 80 | 80 |
| A1/A2 | 1.65 | 1.75 | 1.90 | — | — |
| (A1 + A2)/A0 | 0.16 | 0.15 | 0.14 | — | — |
| W1/R | 3/5 | 1/3 | 1/5 | — | — |
| Stack deviation ΔWx (μm) | 10 | 20 | 50 | 120 | 100 |

TABLE 2

| | Comp. Ex. 4 | Ex. 3 | Ex. 1 | Ex. 4 | Ex. 5 |
|---|---|---|---|---|---|
| Line width W1 (μm) | 60 | 75 | 90 | 100 | 120 |
| A1/A2 | 1.71 | 1.68 | 1.65 | 1.62 | 1.55 |
| (A1 + A2)/A0 | 0.11 | 0.13 | 0.16 | 0.17 | 0.20 |
| W1/R | 2/5 | 1/2 | 3/5 | 2/3 | 4/5 |
| Stack deviation ΔWx μm) | 40 | 15 | 10 | 8 | 6 |

EXAMPLE 2

Figure 4A:
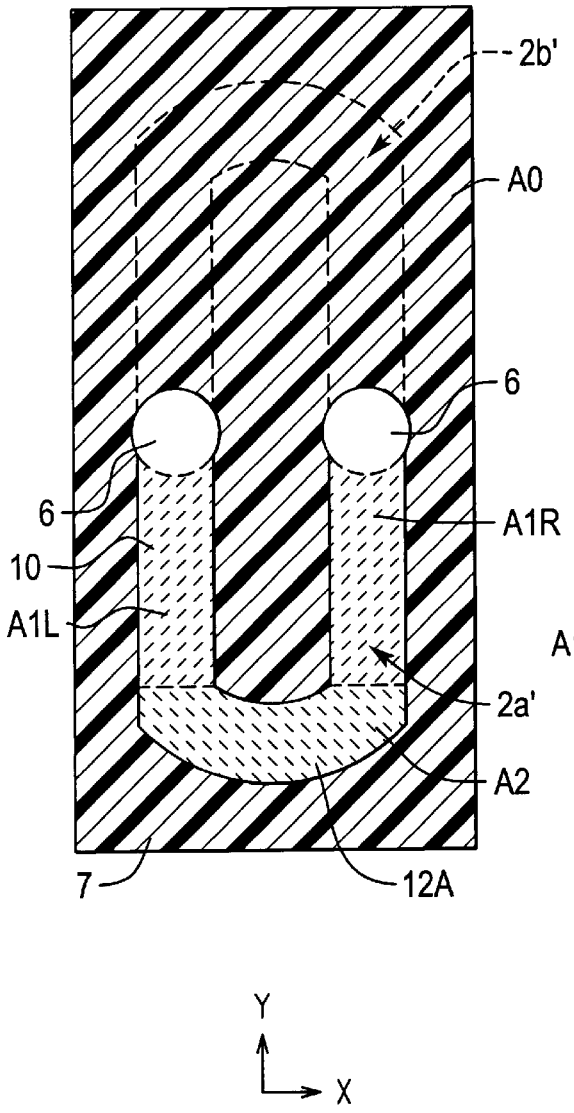
FIG. 4A is a plane view of a coil pattern unit to be stacked inside an inductor device according to an example of the present invention.

The same procedure was followed as in Example 1 to press-bond the green sheets and obtain a stack except that instead of using the coil pattern units 2*a* and 2*b* of the shape shown in FIG. 2A, use was made of coil pattern units 2*a′* and 2*b′* of the shape shown in FIG. 4A.

The curved pattern 12A was shaped as a 1/4 arc, the ratio A1/A2 was 1.75, and the ratio (A1+A2)/A0 was 0.15. Further, the ratio W1/R was 1/3.

The stack was cut using a knife and the section was observed to evaluate the maximum value of the X-direction stack deviation ΔWx.

Table 1 shows the results. The maximum value of the stack deviation ΔWx was 20 μm.

Comparative Example 1

Figure 4B:
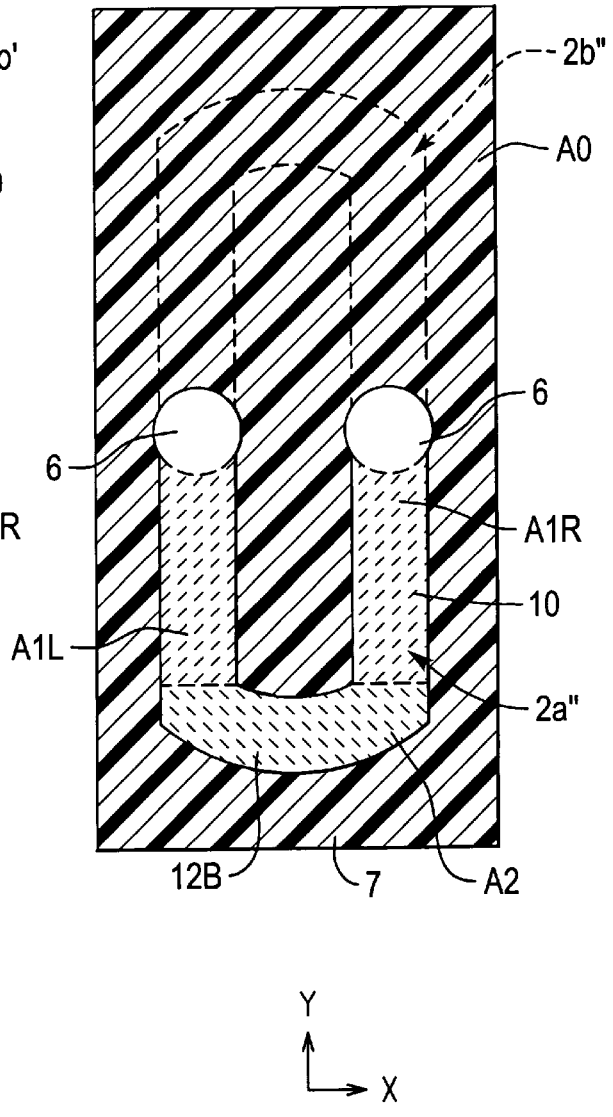
FIG. 4B is a plane view of a coil pattern unit to be stacked inside an inductor device according to a comparative example of the present invention.

The same procedure was followed as in Example 1 to press-bond the green sheets and obtain a stack except that instead of using the coil pattern units 2*a* and 2*b* of the shape shown in FIG. 2A, use was made of coil pattern units 2*a″* and 2*b″* of the shape shown in FIG. 4B.

The curved pattern 12B was shaped as a 1/6 arc, the ratio A1/A2 was 1.90, and the ratio (A1+A2)/A0 was 0.14. Further, the ratio W1/R was 1/5.

The stack was cut using a knife and the section was observed to evaluate the maximum value of the X-direction stack deviation ΔWx.

Table 1 shows the results. The maximum value of the stack deviation ΔWx was 50 μm.

Comparative Example 2

Figure 5A:
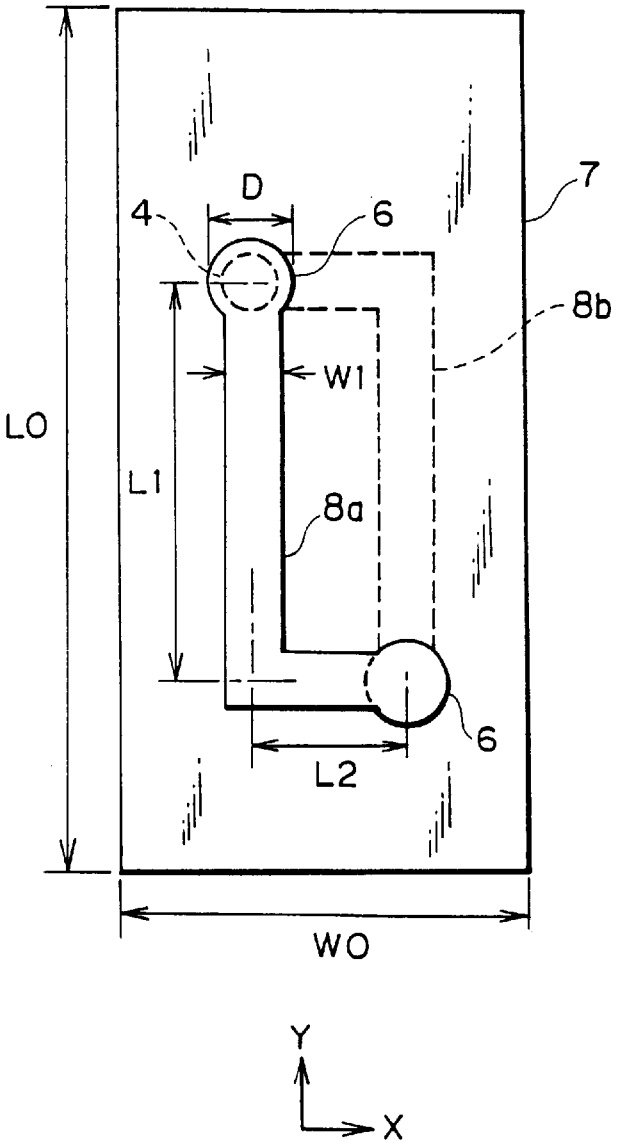
FIG. 5A and FIG. 5B are plane views of coil pattern units to be stacked inside an inductor device according to comparative examples of the present invention.

The same procedure was followed as in Example 1 to press-bond the green sheets and obtain a stack except that instead of using the coil pattern units 2*a* and 2*b* of the shape shown in FIG. 2A, use was made of coil pattern units 8*a* and 8*b* of the shape shown in FIG. 5A.

The coil pattern units 8*a* and 8*b* of the shape shown in FIG. 5A were substantially L-shaped as a whole comprised of a Y-direction long side linear pattern of a line width W1 of 80 μm and an X-direction short side linear pattern of the same width. The length L1 of the long side linear pattern was 0.55 mm and the length L2 of the short side linear pattern was 0.23 mm. The vertically stacked coil pattern units 8*a* and 8*b* were connected at the connection portions 6 through the through holes 4 to form a coil.

The stack was cut using a knife and the section was observed to evaluate the maximum value of the X-direction stack deviation ΔWx.

Table 1 shows the results. The maximum value of the stack deviation ΔWx was 120 μm.

Comparative Example 3

Figure 5B:
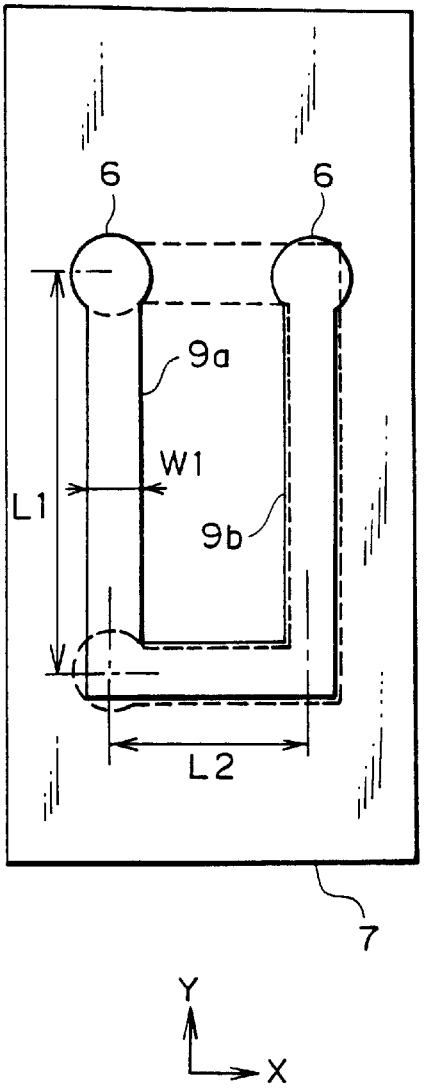

The same procedure was followed as in Example 1 to press-bond the green sheets and obtain a stack except that instead of-using the coil pattern units 2*a* and 2*b* of the shape shown in FIG. 2A, use was made of coil pattern units 9*a* and 9*b* of the shape shown in FIG. 5B.

The coil pattern units 9*a* and 9*b* of the shape shown in FIG. 5B were substantially U-shaped as a whole and did not have any curved patterns. The coil pattern unit 9*a* was comprised of two substantially parallel Y-direction long side linear patterns of a line width W1 of 80 μm and one X-direction short side linear pattern of the same width. Further, the coil pattern unit 9*b* was comprised of two substantially parallel X-direction short side linear patterns of a line width W1 of 80 μm and one Y-direction long side linear pattern of the same width.

The length L1 of the long side linear pattern was 0.55 mm and the length L2 of the short side linear patterns was 0.23 mm. The vertically stacked coil pattern units 9*a* and 9*b* were connected at the connection portions 6 through the through holes 4. The patterns were stacked rotated ¾ of a circumference each time to form a coil.

The stack was cut using a knife and the section was observed to evaluate the maximum value of the X-direction stack deviation ΔWx.

Table 1 shows the results. The maximum value of the stack deviation ΔWx was 100 μm.

EXAMPLE 3

The same procedure was followed as in Example 1 to press-bond the green sheets and obtain a stack except that the line width W1 in the pattern in the coil pattern units 2*a* and 2*b* of the shape shown in FIG. 2A was made 75 μm.

The ratio A1/A2 was 1.68, and the ratio (A1+A2)/A0 was 0.13. Further, the ratio W1/R was ½.

The stack was cut-using a knife and the section was observed to evaluate the maximum value of the X-direction stack deviation ΔWx.

Table 2 shows the results. The maximum value of the stack deviation ΔWx was 15 μm.

EXAMPLE 4

The same procedure was followed as in Example 1 to press-bond the green sheets and obtain a stack except that the line width W1 in the pattern in the coil pattern units 2*a* and 2*b* of the shape shown in FIG. 2A was made 100 μm.

The ratio A1/A2 was 1.62, and the ratio (A1+A2)/A0 was 0.17. Further, the ratio W1/R was 2/3.

The stack was cut by a knife and the section was observed to evaluate the maximum value of the X-direction stack deviation ΔWx.

Table 2 shows the results. The maximum value of the stack deviation ΔWx was 8 μm.

EXAMPLE 5

The same procedure was followed as in Example 1 to press-bond the green sheets and obtain a stack except that the line width W1 in the pattern in the coil pattern units 2*a* and 2*b* of the shape shown in FIG. 2A was made 120 μm.

The ratio A1/A2 was 1.55, and the ratio (A1+A2)/A0 was 0.20. Further, the ratio W1/R was 4/5.

The stack was cut using a knife and the section was observed to evaluate the maximum value of the X-direction stack deviation ΔWx.

Table 2 shows the results. The maximum value of the stack deviation ΔWx was 6 μm.

Comparative Example 4

The same procedure was followed as in Example 1 to press-bond the green sheets and obtain a stack except that the line width W1 in the pattern in the coil pattern units 2*a* and 2*b* of the shape shown in FIG. 2A was made 60 μm.

The ratio A1/A2 was 1.71, and the ratio (A1+A2)/A0 was 0.11. Further, the ratio W1/R was 2/5.

The stack was cut using a knife and the section was observed to evaluate the maximum value of the X-direction stack deviation ΔWx.

Table 1 shows the results. The maximum value of the stack deviation ΔWx was 40 μm.

Evaluation

As will be understood from a comparison of Examples 1 and 2 and Comparative Example 1 as shown in Table 1, the stack deviation becomes smaller when the ratio A1/A2 is in a range not more than 1.85, preferably not more than 1.75. Note that when the ratio A1/A2 is smaller than 1.45, a sufficient inductance cannot be obtained, so the ratio A1/A2 is preferably at least 1.45.

Further, as shown in Table 2, it was learned that when the ratio W1/R is more than 1/2, the stack deviation becomes smaller. More preferably, it was found that the ratio W1/R should be set to a ratio of at least 3/5 giving a stack deviation of less than 10 μm. Note that when the ratio W1/R exceeds 4/5, the diameter of the resultant coil becomes small, so there is a chance that the predetermined inductance characteristic will no longer be reached. The ratio W1/R is therefore preferably-not more than 4/5.

What is claimed is:

1. An inductor device comprising:

two conducting members;

a plurality of insulating layers sandwiched between the two conducting members;

a plurality of single-piece, stacked conductive coil pattern units, each formed on a planar insulating layer, having two parallel linear patterns with first and second ends and a curved pattern continuously formed with first ends beginning at the first end of the curved portion of the linear patterns, and having a ratio A1/A2, where a total of the areas of the two linear patterns in a planar view is A1 and an area of the curved pattern in a planar view is A2, greater than or equal to 1.45 and less than or equal to 1.85; and connection portions formed at each of the second ends of the linear patterns and connecting upper and lower coil pattern units separated by the insulating layers to form a coil shape, wherein the plurality of single-piece, stacked conductive coil pattern units is sandwiched between the two conducting members.

2. The indicator device as set forth in claim 1, wherein a total area of a unit section of the insulating layer in which one-of single-piece, stacked conductive coil pattern unit is contained is A0, and a ratio (A1+A2)/A0 is in a range greater than or equal to 0.10 to less than or equal to 0.30.

3. The inductor device as set forth in claim 1, wherein, a line width of the linear patterns is W1, a radius of curvature of an outer circumference of the curved pattern is R, and a ratio W1/R is in a range greater than or equal to 0.5 to less than or equal to 0.8.

4. The inductor device as set forth in claim 1, wherein two the plurality of single-piece, stacked conductive pattern units positioned above and below an insulating layer are arranged at line symmetric positions with respect to a center line dividing the insulating layer across a longitudinal direction in a planar view.

5. The inductor device as set forth in claim 1, wherein the plurality of single-piece, stacked conductive coil pattern units are line symmetric patterns about a center line dividing the insulating layer across a width direction in a planar view.

6. The inductor device as set forth in claim 1, wherein two or more of the plurality of single-piece, stacked conductive coil pattern units are arranged between insulating layers.

* * * * *